US005950325A

United States Patent [19]

Mehdizadeh et al.

[11] Patent Number: 5,950,325

[45] Date of Patent: Sep. 14, 1999

[54] METHOD AND APPARATUS FOR LOW TEMPERATURE CONTINUOUS DRYING OF TEMPERATURE SENSITIVE MATERIALS (GRANULAR AGRICULTURAL PESTICIDES) AT ATMOSPHERIC PRESSURE USING RADIO FREQUENCY ENERGY

[75] Inventors: Mehrdad Mehdizadeh; Roy Quinn Freeman, III, both of Wilmington, Del.; William Lawrence Geigle, West Chester, Pa.; Earl Williams, Jr., North East, Md.

[73] Assignee: E. I. du Pont de Nemours and Company, Wilmington, Del.

[21] Appl. No.: 08/948,883

[22] Filed: Oct. 10, 1997

Related U.S. Application Data

[63] Continuation of application No. 08/675,471, Jul. 3, 1996, abandoned

[60] Provisional application No. 60/000,916, Jul. 6, 1995.

[51] Int. Cl.[6] ..... F26B 3/34

[52] U.S. Cl. ..... 34/256; 34/363; 34/367; 34/502; 34/535; 34/545; 34/546; 34/68; 219/701; 219/705

[58] Field of Search ..... 34/246, 255, 256, 34/259, 265, 363, 367, 426, 427, 486, 487, 494, 502, 507, 535, 545, 546, 68; 219/684, 701, 705

[56] References Cited

U.S. PATENT DOCUMENTS

| | | | |
|---|---|---|---|
| 2,783,345 | 2/1957 | Warren | 219/10.55 |
| 3,528,179 | 9/1970 | Smith | 34/1 |
| 3,532,848 | 10/1970 | Loring, Jr. et al. | 219/10.61 |
| 4,038,052 | 7/1977 | Melcher et al. | 34/246 X |
| 4,208,806 | 6/1980 | Manser et al. | 34/259 |
| 4,468,865 | 9/1984 | Inagaki | 34/265 |
| 4,879,444 | 11/1989 | Bichot et al. | 219/10.55 A |
| 5,024,004 | 6/1991 | Jaeger | 34/1 |
| 5,341,576 | 8/1994 | Tsutomu et al. | 34/259 X |
| 5,378,319 | 1/1995 | Tran et al. | 219/701 X |

FOREIGN PATENT DOCUMENTS

| | | | |
|---|---|---|---|
| 924475 | 4/1982 | U.S.S.R. | F26B 3/34 |

*Primary Examiner*—Henry Bennett
*Assistant Examiner*—Steve Gravini

[57] ABSTRACT

The present invention provides a method and apparatus for agitation-free, low temperature drying of fragile, temperature sensitive, granular materials at atmospheric pressure using Radio Frequency (RF) energy to provide the heat of evaporation. A relatively low velocity flow of purge air through either a continuously moving or stationary product bed provides means for removing moisture from the product at atmospheric pressure. The purge air is maintained at a controlled humidity, temperature and velocity, and the intensity of the RF field is controlled in response to temperature sensing means to control the temperature of the product. For the case of a continuously moving product bed the RF applicator is preferably divided into multiple zones, which may be independently controlled, to effect control of the moisture and temperature profile of the product as it passes through the apparatus. The total air flow is kept to the minimum necessary to remove the moisture, which minimizes agitation of the product, minimizes fracturing of the granules and maximizes first pass yield.

27 Claims, 6 Drawing Sheets

METHOD AND APPARATUS FOR LOW TEMPERATURE CONTINUOUS DRYING OF TEMPERATURE SENSITIVE MATERIALS (GRANULAR AGRICULTURAL PESTICIDES) AT ATMOSPHERIC PRESSURE USING RADIO FREQUENCY ENERGY

This is a continuation of application Ser. No. 08/675,471 filed Jul. 3, 1996, now abandonded.

This application claims the priority benefit of U.S. Provisional Application 60/000,916, filed Jul. 6, 1995.

BACKGROUND OF THE INVENTION

1. Field of the Invention

The present invention relates to a method and an apparatus for low temperature, continuous drying of temperature sensitive materials, especially granular agricultural pesticides, at atmospheric pressure using radio frequency energy.

2. Description of the Related Art

Many products are sold in granular form. Products such as agricultural pesticide and herbicide products are often sold to the end-user as dry, water-dispersible granules. The chemical compounds having the pesticidal or herbicidal activity contained in these products, however, are typically not water soluble. These products must be formulated with additives to produce water-dispersible granules for the use by the end-user. The active ingredients and the additives which comprise the product formulation are typically manufactured as one or more fine powders. To agglomerate the formulation to form larger particles or granules, suitable for end user application, water and sometimes other solvents are added. This moisture or solvent must be driven out after the granules are formed, without damaging or degrading the product. In the drying step the moisture level must be typically reduced from a range of 5%–30% to below 1%, since the granules can stick together and cause product caking at higher moisture levels.

In a common granulation method, known in the art as pan granulation, water is added to the powder(s) and the mixture tumbled or agitated to form the agglomerates. The water is then driven out of the agglomerated product in the drying step. In an another method of granulation, known as paste extrusion, water is added to the powder formulation and a paste is formed. The paste is then extruded into filaments (or extrudates). These extrudates are subsequently dried and then cut into proper size granules prior to packaging and sale.

Since the active ingredients of these formulations easily degrade when subjected, even for relatively short periods of time, to temperatures above a certain threshold, the drying process must be performed below a specified maximum temperature, typically in the range of 60° C. to 90° C. A common method of drying for either pan granulated or extruded formulations is known as vibrating fluidized bed drying. Vibrating fluidized bed drying is performed by supplying high flow rate of warm air, at a velocity typically exceeding 50 meters (~150 feet) per minute, to a bed of the wet product. This high velocity air flow delivers the heat of evaporation to the product, mechanically fluidizes the product bed, and removes the vaporized moisture from the process. Vibration of the whole vessel is used to aid the fluidization of the product bed. The humid and typically dusty exhausted process air is then passed through a dust collector, filtered, refrigerated to remove the moisture, re-heated to the specified process temperature, and then fed back into the process.

Such a process is disadvantageous due to the large volume of air required per unit volume of product. The air handling system for such a process is quite large in physical dimensions, represents a large investment of capital, and, due to its energy consumption, is expensive to operate. The agitation of the product inherent in such a drying process partially breaks up the granules and creates large volumes of fines or dust, which reduces the first pass process yield. These fines must be removed from the air cycle and returned for regranulation.

In many processes involving thermally sensitive materials, such as pharmaceuticals, vacuum drying is used, either with or without the aid of an external heating mechanism. The vacuum lowers the boiling point of water (or other solvent), and the drying can be accomplished at a low temperature. Equipment for vacuum drying, commonly used for relatively high value, thermally sensitive products manufactured in relatively small batches, represents a large capital investment. Vacuum drying is inherently a batch process, while the manufacture of granular agricultural products is inherently a continuous process and thus requires a continuous drying process step.

Dielectric or Radio Frequency (RF) drying has been in use in several industries. For example, it is used for drying of textiles, and foodstuffs, and polymers. In RF drying the wet material is placed an intense electric field at a high frequency (typically 10 MHz to 100 MHz). The dipolar molecules of water are rotated at this frequency. The frictional losses at the molecular level generate heat, which evaporates and move the water molecule to the surface of the product. The conventional theory is that the temperature of the material needs to reach the boiling point of water (or the solvent), in order for this evaporation to take place. This conventional thinking has limited the application of dielectric drying to either temperature insensitive products or in the case of temperature sensitive products, to vacuum drying systems when the maximum allowable temperature is below the boiling point of water (or solvent) at atmospheric pressure.

SUMMARY OF THE INVENTION

The present invention addresses the process requirements discussed above, and provides a method and apparatus for agitation-free, low temperature drying of fragile, temperature sensitive, granular materials at atmospheric pressure using Radio Frequency (RF) energy to provide the heat of evaporation. A relatively low velocity flow of purge air through either a continuously moving or stationary product bed provides means for removing moisture from the product at atmospheric pressure. The purge air is maintained at a controlled humidity, temperature and velocity, and the intensity of the RF field is controlled in response to temperature sensing means to control the temperature of the product. For the case of a continuously moving product bed the RF applicator is preferably divided into multiple zones, which may be independently controlled, to effect control of the moisture and temperature profile of the product as it passes through the apparatus. The total air flow is kept to the minimum necessary to remove the moisture, which minimizes agitation of the product, minimizes fracturing of the granules and maximizes first pass yield.

BRIEF DESCRIPTION OF THE DRAWINGS

The accompanying drawings, which are incorporated in and constitute a part of the specification, illustrate the presently preferred embodiments of the invention and, together with the general description given above and the detailed description of the preferred embodiments given below, serve to explain the principles of the invention.

FIG. 1 shows the components according to a first, batch mode, embodiment having a supply air plenum which is separate from the grounded electrode.

FIG. 2 shows the components according to an alternate arrangement of the batch mode embodiment, where the grounded electrode is perforated and is incorporated as part of the supply air plenum.

FIG. 3 shows the components according to a second, continuous mode, embodiment.

FIG. 4 shows the components of an alternate arrangement of the continuous mode embodiment, having two drying zones, each drying zone having a separate air plenum.

FIG. 5 shows the components of a second alternate arrangement of the two zone continuous mode embodiment, each drying zone having a different spacing between the respective energized and the grounded electrode.

FIG. 6 shows the components of a third alternate arrangement of the continuous mode embodiment, wherein the energized electrode is inclined with respect to the grounded electrode in the product conveying direction.

DETAILED DESCRIPTION OF THE INVENTION

Figure 1:
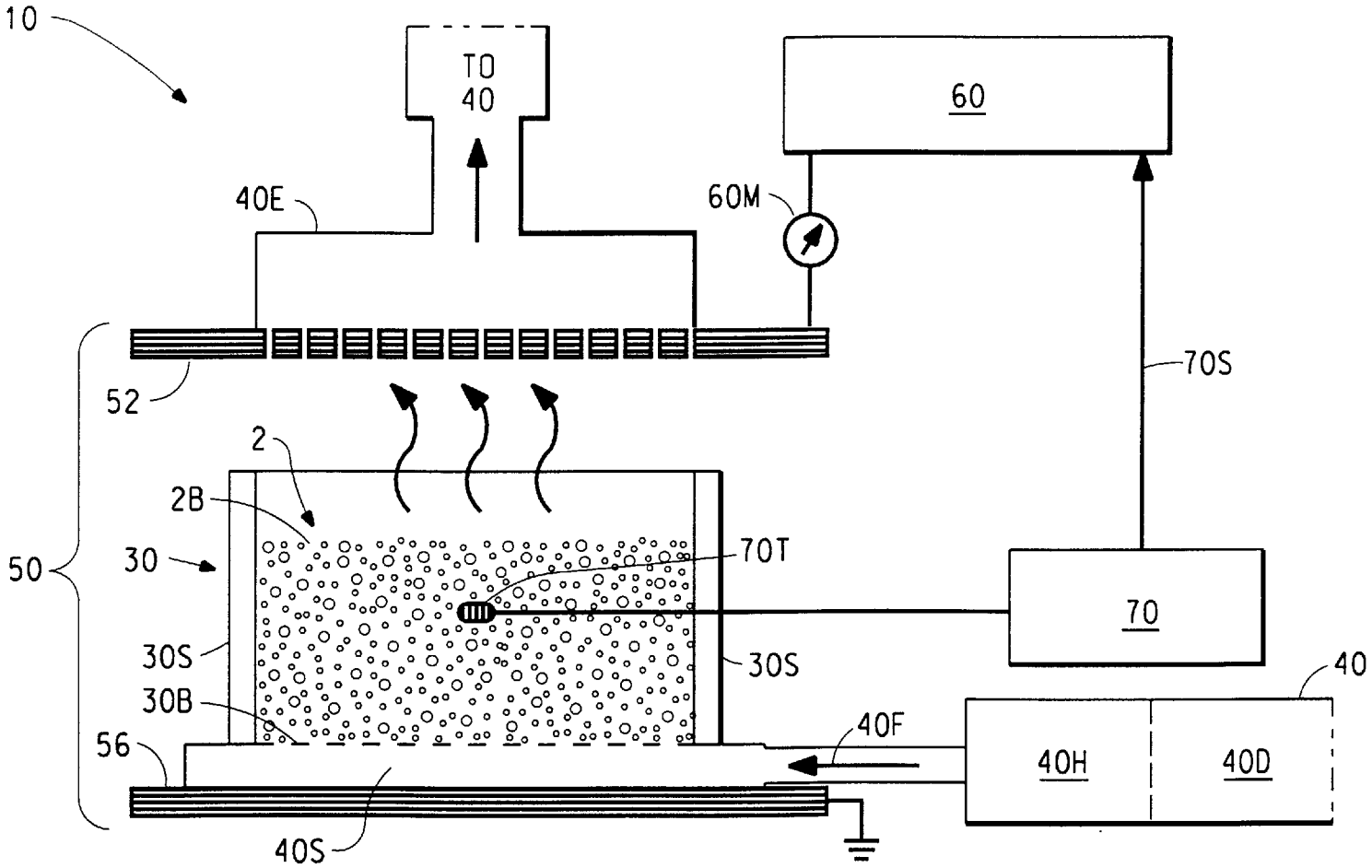
FIGS. 1–6 are elevational views, partly in section and partly diagrammatic, showing alternate component arrangements of two embodiments of the present invention.

Consider a bulk of granular material with volume V, is subjected to a uniform RF field and a uniform purge gas permeating through the bulk. The RF energy deposited into a unit volume of the material is expressed as:

$$P=KfE^2e''V \tag{1}$$

Where P is power deposited in Watts, K=5.56 $10^{-11}$, E is the RF electric field in Volts/meter, and e" is the material's bulk loss factor at frequency f.

During the infinitesimal time period dt, the RF energy entering the bulk is expressed as:

$$dQ_{rf}=Pdt \tag{2}$$

The RF energy into the bulk is divided two ways:

$$dQ_{rf}=dQ_e+dQ_s \tag{3}$$

where $dQ_e$ is the heat of evaporation, and $dQ_s$ is the sensible heat.

In absence of an air flow through the bed of product, initially very little evaporation takes place. Most of the RF energy results in a rise in temperature of the product bed. As the temperature rises above 100° C., the boiling point of water at atmospheric pressure, some evaporation occurs. The vapor stagnates, and some superheating may occur.

In the method of the present invention, an air flow, preferably at the goal maximum temperature, is permeated uniformly throughout the bed of the product while RF energy is being applied. The uniform air flow aids in evaporating the moisture from the bed of the product, while providing evaporative cooling throughout the product, and removes the moisture from the immediate vicinity of the product. The velocity of the air flow controls the rate of heat removal. One or more temperature sensors provide input to a feedback controller, which controls the intensity of the RF energy, to keep the product temperature below the maximum desired level, which for agricultural herbicides and pesticides, is typically in the range of 60° C. to 90° C. Experimental results, as will be discussed hereinafter in the examples section, show that the drying process can be accomplished quickly, within minutes using this process. The heat of evaporation can be expressed as:

$$dQ_e=1dm_w \tag{4}$$

where 1 is the latent heat of water in joules per kilogram (J/kg), and $dm_w$ is the loss of water mass from the bulk during the time period dt. Introducing the function A(t) as the moisture factor, the time-dependent specific weight of the material is:

$$p(t)=r_0[1+A(t)] \tag{5}$$

where $p_0$ is the bulk dry density of the material. The weight, dmw, then becomes:

$$dm_w=p_0V[1+A(t=dt)=r_0V[1+A(t)] \tag{6}$$

Then:

$$dm_w>>-r_0VdA \tag{7}$$

Therefore:

$$dQ_e=-1r_0VdA \tag{8}$$

The sensible heat term can be expanded as:

$$dQ_s=C_p(t)mdT \tag{9}$$

Where Cp(t) is the heat capacity of the material in J/Kg–° C., and m is the total mass of the bulk, and dT is the temperature rise during the time period dt. The mass m itself is moisture dependent. Therefore:

$$dQ_s=C_p(t)Vr_0[1+A(t)]dT \tag{10}$$

Combining Equations 1, 2, 3, 8, and 10, yields:

$$KFe(T)^2e''(t)=-1r_0\frac{dA}{dt}+C_p(t)r_0[1=A(t)]\frac{dT}{dt} \tag{11}$$

In (11), the left side of the equation shows the total RF energy, while the right hand shows two terms, one is the evaporation, and the second represents temperature increase. The uniform flow of air increases the first evaporation term and reduces the second temperature increase term. Therefore the quicker the material dries, (large dA/dt), the lower the temperature increase will be. By proper control of RF power application and air flow, the second temperature increase term can be decreased essentially to zero (dT/dt=0) for most of the process duration.

In the method of the present invention, an air flow, preferably at the goal maximum temperature, is permeated uniformly throughout the bed of the product while RF energy is being applied. The uniform air flow aids in evaporating the moisture from the bed of the product, while providing evaporative cooling throughout the product, and removes the moisture from the environment. The velocity of the air flow controls the rate of heat removal. One or more temperature sensors provide input to a feedback controller, which controls the intensity of the RF energy, to keep the product temperature below the maximum desired level, which for agricultural herbicides and pesticides, is typically in the range of 60° C. to 90° C.

Generally stated, the method of the present invention subjects a granular product to a uniform RF field of controlled energy intensity at a given frequency while simultaneously providing a uniform air flow of controlled velocity and temperature through the product. The product is dried quickly at essentially atmospheric pressure at a temperature significantly below the boiling point of water (or the solvent).

A preferred apparatus arrangement places the product bed between one or more pairs of parallel flat electrodes, one of which is at ground potential, and the other of which is energized with RF. A preferred RF frequency is in the 27 MHz frequency band approved for ISM (Industrial, Scientific, and Medical) use by regulatory authorities. This frequency band, due to its large wavelength, provides reasonably good field uniformity over large product bed sizes. Equipment in this frequency range is readily available commercially. Conceptually, a large range of frequencies in RF and microwave range can be used (10 MHz to 3000 MHz). A RF field strength of 10 kV/Meter to 50 kV/meter is preferred. This range of RF field strength, as may be seen from Equation 1, would provide sufficient RF energy deposition into the product at the 27 MHz frequency band. Since Equation 1 is frequency dependent, for other frequency ranges appropriate levels of RF field strength could be used.

An alternate mode of application of RF energy could be employed if desired. For example, in the microwave frequency range (300–3000 MHz), a wave guide applicator, or a cavity resonator could be used in place of the parallel flat electrodes.

A preferred range of air flow velocity is 3 meters (~10 ft)/minute to 10 meters (~30 ft)/minute through the product bed. A preferred temperature of the air is in the range of 50° C. to 80° C., according to the temperature sensitivity of the specific product. This range of air flow velocities and temperatures, have been found to provide adequate cooling of the product bed, as well as sufficient moisture removal.

The drying process of the present invention may be performed in either a continuous or a batch mode. FIG. 1 shows a first arrangement for drying of a granular product bed 2. This first embodiment of an apparatus 10 is useful for batch mode drying. The granular product bed 2 is spread in a uniform layer, or bed 2B and is held in a vessel 30 made of insulating material, preferably a material which is not highly susceptible to heating by RF energy. The vessel 30 has side walls 30S and a perforated bottom 30B and a supply air plenum 40S below it. The geometry of perforations allow air flow, but prevents loss of the product 2. The plenum 40S is maintained at a slightly positive pressure, in order to aid in uniformity of the air flow through the product bed 2B. The product bed 2B is located within an RF applicator 50, comprising a pair of RF electrodes 52, 56. One electrode 52, preferably top electrode 52 is energized at a high RF voltage potential by an RF generator 60, while the bottom electrode 56 is at ground potential. If desired a voltage indicating meter 60M may be employed to indicate the voltage applied to the energized electrode 52. The electrode 52 is perforated and connected to an air handling system 40 by an air exhaust, or extraction, plenum 40E. The dry air flow, shown by the arrow 40F, is fed into the plenum 40S from the air handling system 40, which may be controlled to produce the prescribed velocity in the product bed 2B, and which dries (subsystem 40D) and heats (subsystem 40H) the air to the proper moisture level and temperature. The exhaust plenum 40E may either exhaust the moist air to the atmosphere or return it to the air handling system 40. At least one temperature sensor 70T, preferably a thermometer probe of a type that is not affected by RF field, such as fluoro-optic probe, is inserted in the product bed 2B, and is connected to a thermometer instrument 70, also known as a temperature measurement module. A control signal 70S from the thermometer instrument 70 is used to control the RF power from the RF power generator 60. The control scheme is such that the RF power is adjusted so that the product 2 is heated to the maximum allowable temperature, according to the specific product being dried, and the product 2 is held at that temperature for the duration of drying.

Figure 2:
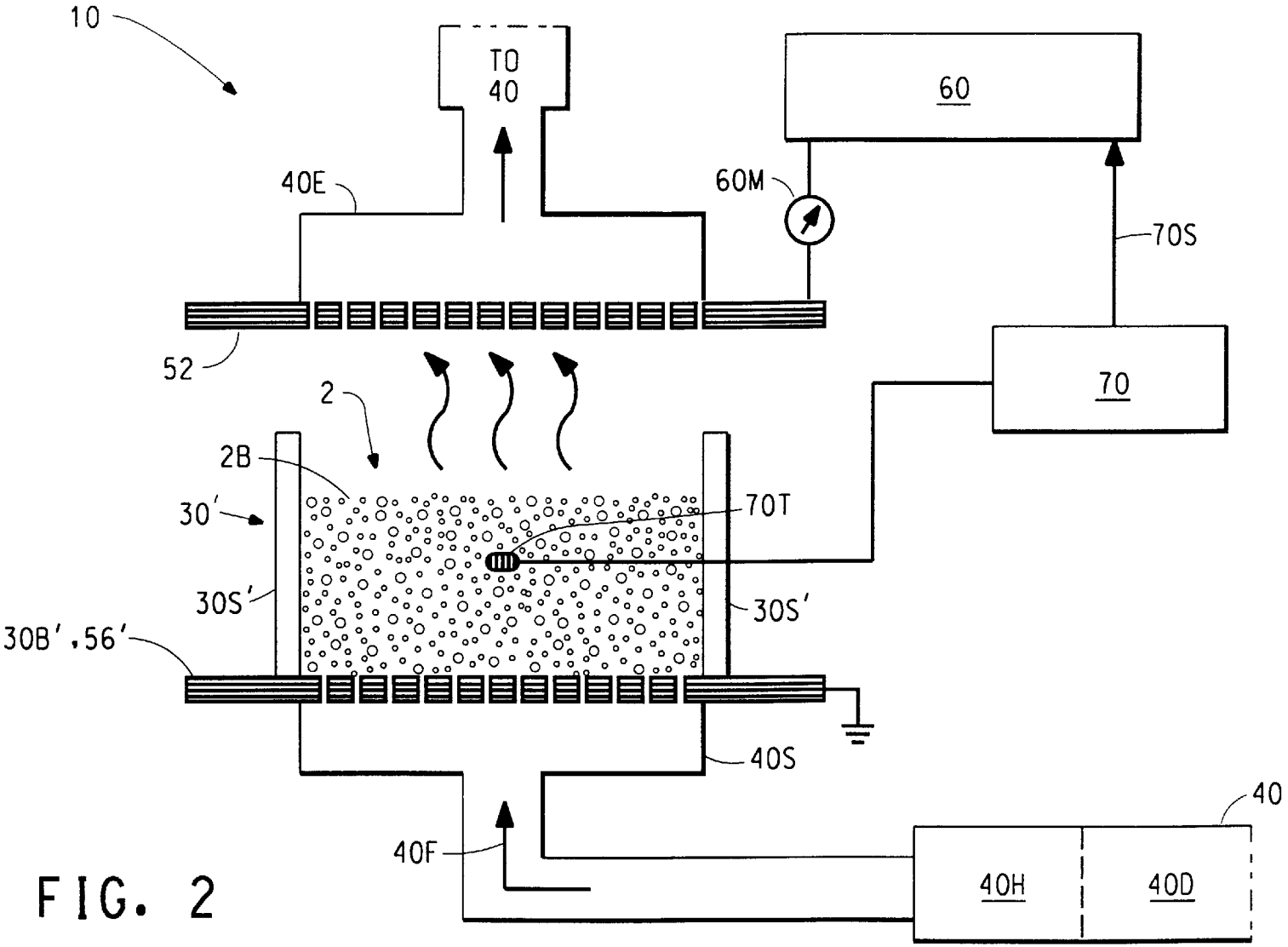

In an alternate arrangement of the first embodiment, as shown in FIG. 2, the bottom electrode 56' is perforated and incorporated as part of the supply air plenum 40S. The supply air plenum 40S under the product bed is thus similar to the air exhaust plenum 40E at the top. As illustrated in FIG. 2, the product vessel 30' may either have only side walls 30S', with the bottom electrode 56' serving as the vessel bottom 30B', or it may also have a perforated bottom adjacent to the perforated bottom electrode (similar to FIG. 1).

Figure 3:
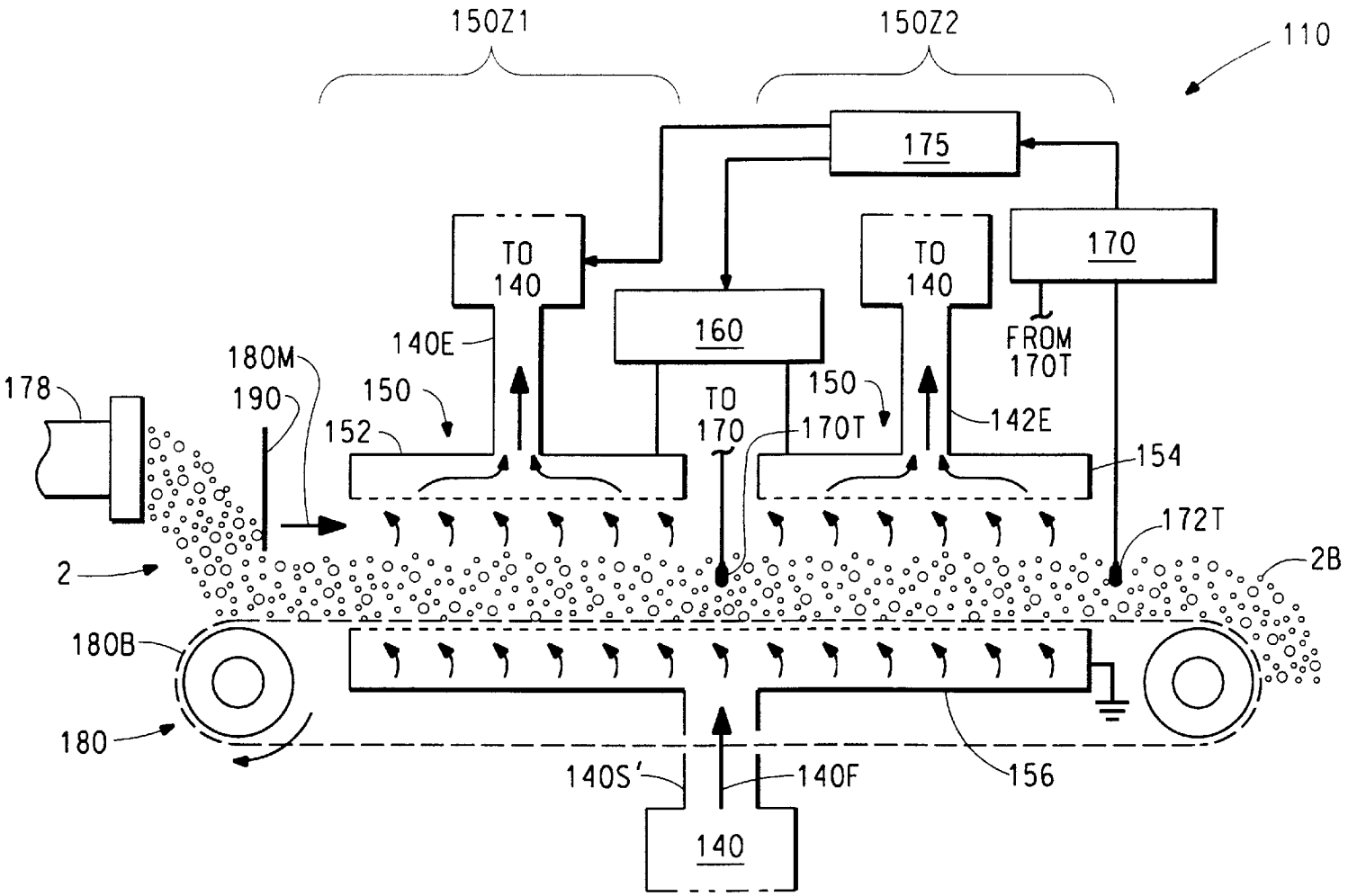

FIG. 3 shows a second embodiment of a apparatus arrangement 110 useful as a continuous process apparatus. Since a continuous process is more desirable for commercial purposes, this is the most preferred embodiment of this invention. The RF applicator 150 is preferably composed of more than one upper, energized, high voltage (also called hot) RF electrodes 152, 154, and a single lower ground electrode 156. The product 2 is fed from a storage bin (or extruder) 178 by gravity onto a conveying system 180 and the product bed 2B is shaped to the desired height and width using on or more doctor blades 190. The product is conveyed in a direction shown by arrow 180M, typically on a perforated conveyor belt 180B located between the energized and ground electrodes. The lower ground electrode 156 is preferably perforated, with an air plenum 140S' under it. The upper energized electrodes 152, 154 are preferably also perforated with each having an exhaust or return plenum 140E, 142E for collecting exiting moist air. The upper electrodes 152, 154 serve to define individual drying zones 150Z1, 150Z2. As the product 2 is conveyed on the conveyor belt 180B, it is subjected to an RF field between the energized 152, 154 and ground electrodes 156, and to a uniform flow of air permeating through the product, shown by the arrows 140F. Several temperature sensors 170T, 172T preferably one per drying zone are disposed to be in contact with the product 2. The temperature sensors 170T, 172T are preferably the fluoro-optic probe, as described with respect to FIG. 1, inserted into the product bed. A thermometer instrument 170, in combination with a controller 175, controls the output voltage of RF generator 160 and thus the electric field intensity in each drying zone 150Z1, 150Z2 to maintain the product 2 at the desired temperature as it is dried. Controller 175 may also provide an output to air handling system 140 to control the flow rate, temperature and humidity of the gas through the granular material 2, and an output to conyeyor system 180 to control the speed of the layer of the granular material 2B through the applicator 150.

Figure 4:
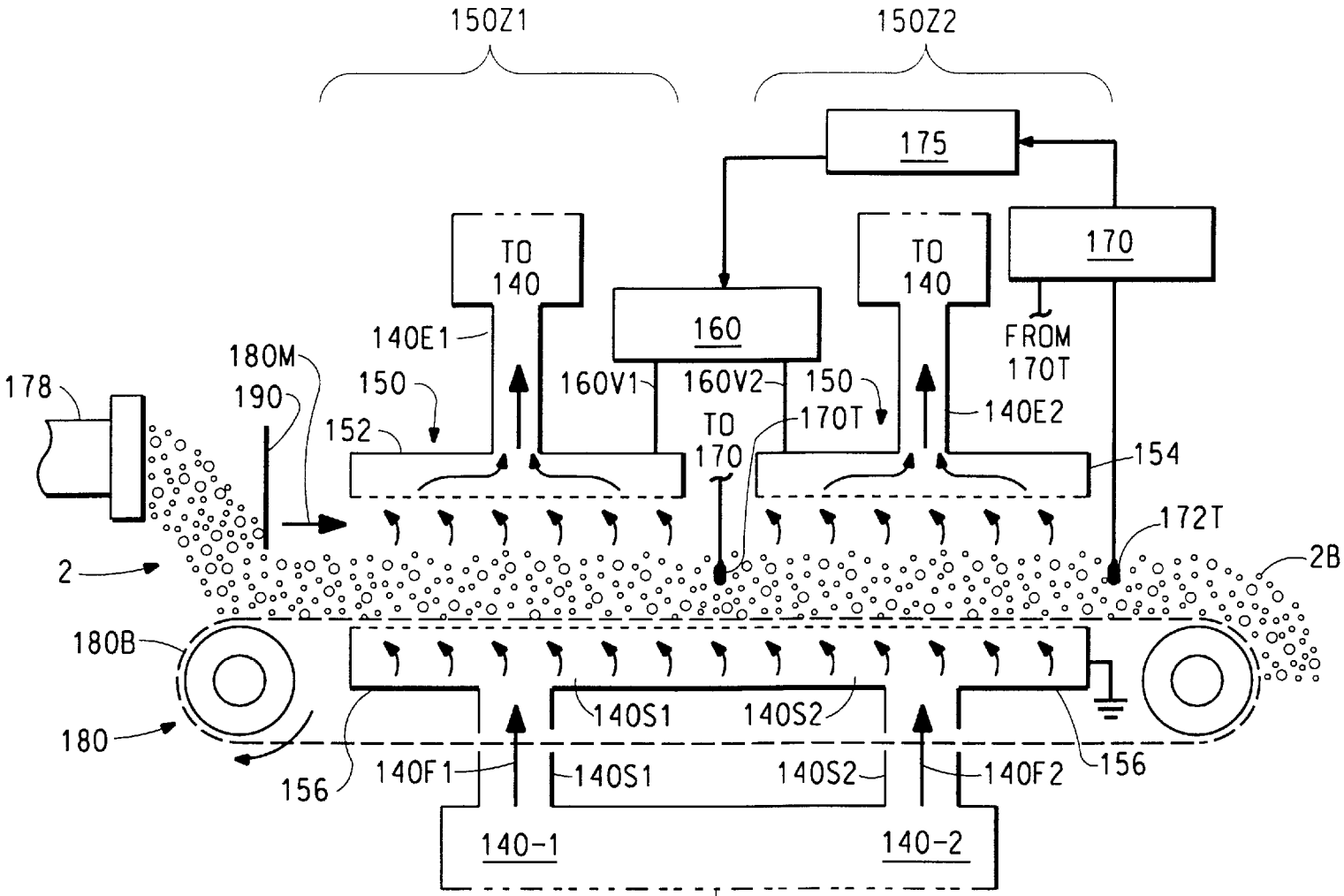

As may be appreciated from Equation 11 above, it may be desirable to maintain a desired temperature and moisture profile along the conveyor belt 180B. Several alternate arrangements may be employed to achieve the desired temperature and moisture profile. FIG. 4 illustrates an arrangement of the continuous mode embodiment, having two drying zones, each drying zone having a separate supply air plenum 140S1, 140S2 and exhaust air plenum 140E1, 140E2. The temperature, moisture content and rate of the air flow 140F1, 140F2 in each plenum may be individually controlled by an air handling system 140 comprised of parallel units 140-1, 140-2.

Figure 5:
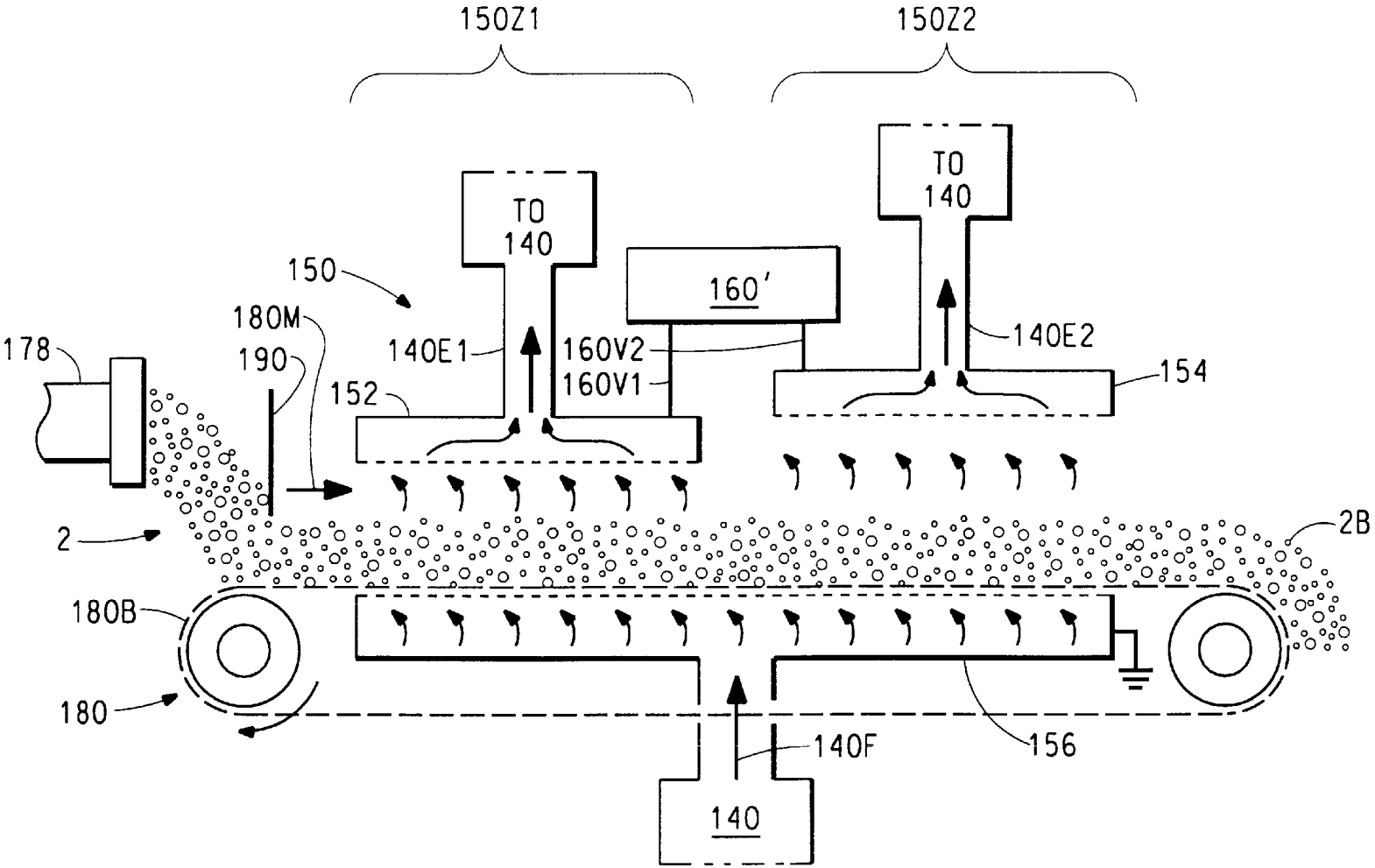
Figure 6:
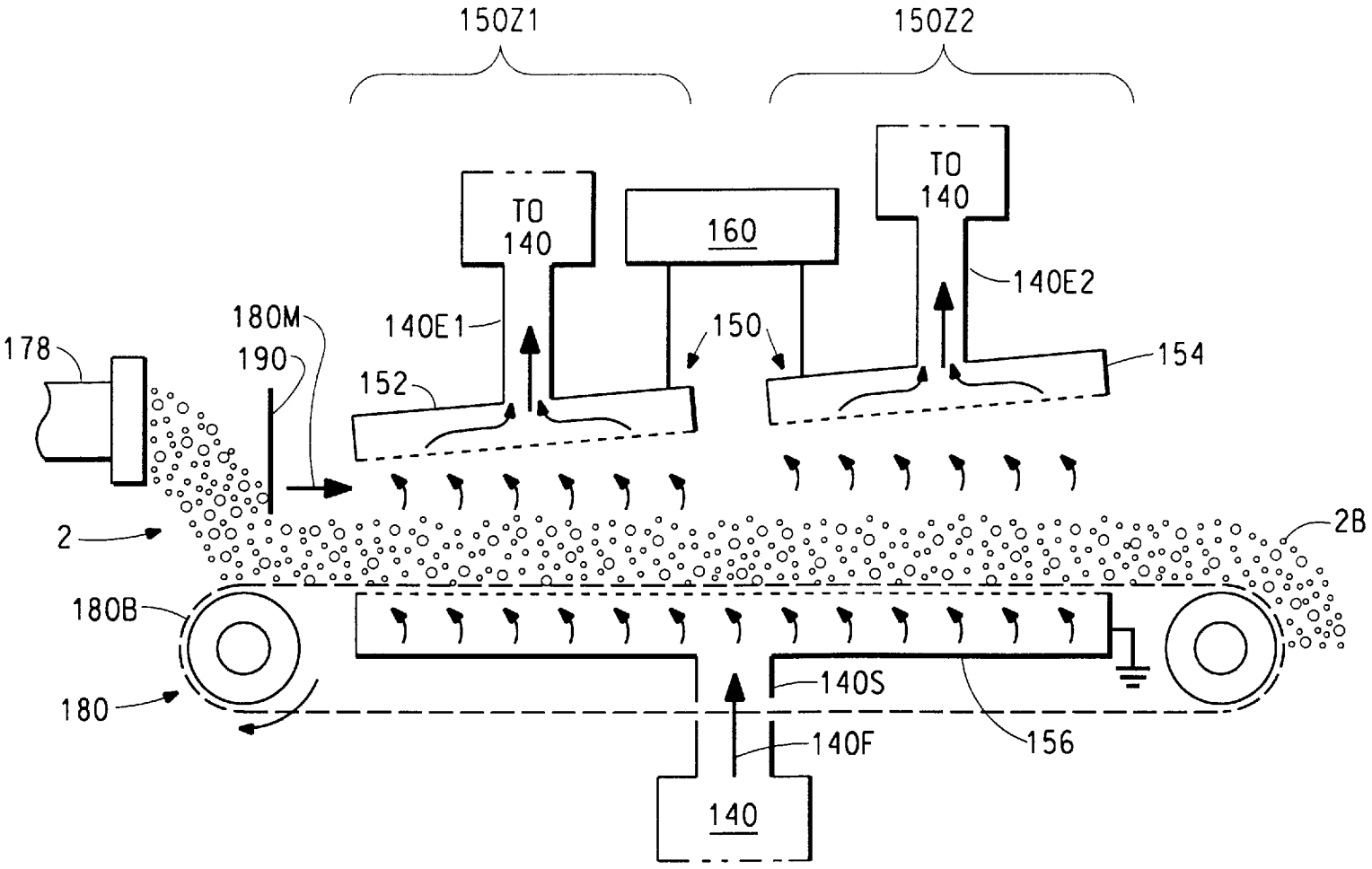

FIGS. 5 and 6 have been simplified for clarity by not showing components 170, 170T and 172T, 175. FIG. 5 illustrates an arrangement having multiple energized electrodes 152, 154, each energized electrode being individually positioned with respect to a common, grounded electrode 156 to provide a different electric field intensity to the product region immediately under the respective energized electrode. An RF generator 160', having multiple, individually controlled outputs 160V1, 160V2 may be employed such that each respective electrode 152, 154 would provide a different electric field intensity to the product region immediately under it. This difference in electric field intensity can serve as an additional means for maintaining the desired moisture and temperature profiles. FIG. 6 shows the components of a third alternate arrangement of the continuous mode embodiment, wherein the energized electrodes 152, 154 are inclined with respect to the grounded electrode 156 in the product conveying direction 180M so that the spacing between the energized electrode and the grounded electrode increases as the product 2 advances through the applicator 150. The energized electrodes 152, 154 may also be of a shape such that a portion of the electrode is planar and in parallel relation to the grounded electrode 156 and a portion is inclined with respect to the grounded electrode 156 (not shown). The use of other electrode shapes are to be considered as being within the scope of the above teaching, to achieve the purpose of controlling the profile of the electric field intensity, and thus the product moisture and temperature profile in the product conveying direction 180M through the applicator 150.

EXAMPLES

Batch-Mode Experiments

In order to characterize the drying mechanism of the present method, and collect basic data, batch experiments were performed using the arrangement of FIG. 3. A rectangular vessel, approximately ten (10) centimeters (~four inches) in width, fifteen (15) centimeters (~six inches) in length, and ten (10) centimeters (~four inches) in height, with walls formed of polytetrafluoroethylene (PTFE) and with a perforated bottom formed of a fiberglass reinforced polyester mesh having a mesh size of 0.5 mm, was used. This vessel holds approximately 650 grams of wet material at a bed height of about seven (7) centimeters (~three inches). A purge air flow of about 60 liters/minute at a temperature of 75° C. was blown from the bottom of the bed through the product. This flow rate produced an air velocity of about 5 meters (15 feet)/minute. The vessel was then put between the electrodes of a parallel-plate batch RF dryer with maximum power of 3 kW, and a frequency of 37 MHz. The applicator for this system was fabricated from two thirty (30) centimeter by thirty (30) centimeter square aluminum plates for the experiment. For this initial experiment the plates were not perforated. The RF generator is a Thermall Model 3000H. For temperature monitoring, two Model 755 fluoro-optic probes, manufactured by Luxtron Co., Santa Clara, Calif., were inserted in the product bed. Several product batches with moisture levels ranging from 10% to 30% were dried in this system. For a test involving a material with 29% initial moisture, a drying rate of fifty (50) kilograms per square meter (~10.25 pounds per square foot) of water per hour was achieved. This drying rate equals or betters the drying rates achieved for the same material with typical fluidized bed dryers.

In order to find the role of RF energy in the drying, an experiment was conducted to compare moisture reduction with air flow only, and RF energy plus air flow. In a first experiment a first sample of a granular herbicide with an initial moisture level of 15% was dried as described above. The maximum temperature of the product was controlled to 60° C. The product dried to a moisture level of less than 1% in fifteen minutes. In a second experiment an identical sample of a granular herbicide with an initial moisture level of 15% was dried as described above, but without the RF energy being applied. The temperature of the product bed never exceeded 30° C. and after fifteen minutes the moisture level was reduced to only 14%.

Continuous-Mode Experiments

In a continuous drying experiment, 1200 lbs (545 Kg) of a paste-extruded herbicide, with the initial moisture content of 28% was dried. An RF dryer with the maximum power level of 25 kW, operating at the frequency of 27.12 MHz manufactured by Strayfield Ltd., was used. The dryer was modified to have air handling arrangement of FIG. 1. There are two energized electrodes, each with the length of 130 cm (in the direction of product flow), and the width of 60 cm. A conveyor belt 61 cm in width, made of glass-reinforced polyester mesh with the mesh sizes of 0.5 mm allows for the air to pass through the granular product be as it is transported between the energized and grounded electrodes. The granules of the product were of circular cylindrical shape with the diameter of 1 mm, and varying in length from 3 mm to 10 mm. The product was fed by gravity onto the conveyor belt and the product bed was shaped to the desired height and width using doctor blades. The cross section of the product bed was trapezoidal, with the base of 48 cm, height of 5 cm, and the angle of repose of 45°. The total length of the drying zone was 306 cm, which included a 46 cm dead zone between the two electrodes. At a conveyor belt speed of 6.8 meters per hour the throughput of the product was 91 kg per hour. The air plenum under the product bed was 320 cm long, 42 cm wide, and 15 cm in height. The perforations in the electrode under the conveyor belt were circles 5 mm in diameter, arranged in a square pattern with 4 cm distance in between. The air flow for this experiment was 14,200 liters per minute (~500 cubic feet per minute) at substantially atmospheric pressure. The residence time of the product in the drying zone was 27 minutes. The product was dried to a moisture level of between 0.45% to 0.95% water content. A temperature measurement and control mechanism, as shown in FIG. 1 was used with manual control of the radio frequency power level. The product's maximum temperature was held at 80° C. throughout the experiment.

What is claimed is:

1. An apparatus for drying temperature sensitive granular material having an initial solvent content in the range of 5 to 30 percent by weight to a solvent content of less than one percent by weight in an energy efficient manner, such that the material does not exceed a predetermined temperature, said temperature being substantially less than the boiling point of the solvent, comprising:

a) applicator means for creating a substantially uniform high frequency electric field of an intensity in the range of 10–30 kV/meter, the applicator means comprising a source of radio frequency energy having an input control port and a high voltage output port, said input control port effecting control of the high voltage output, and at least one energy electrode and at least one grounded electrode electrically connected to said source, said electrodes being generally planar and having perforations to facilitate gas flow therethrough;

b) gas supply, collection and drying means for causing a substantially uniform dry gas to flow, at a controlled rate, temperature and humidity, through perforations of at least one electrode and be collected through perforations of at least another electrode;

c) conveyor means for conveying a layer of the granular material through the applicator means at a controlled speed comprising a gas permeable belt between said electrodes, so that the gas flows through the electrode perforations, through the belt, and through said layer of granular material;

d) temperature sensing means for sensing the temperature of the layer of granular material, comprising at least one temperature probe and a temperature measurement module, said module creating an electrical signal representative of the temperature of the granular material; and e) controller means, electrically connected to the temperature sensing means, for controlling the intensity of the electric field, and the flow rate and temperature of the gas through the granular material, such that the material does not exceed a predetermined temperature, the temperature being substantially less than the boiling point of the solvent.

2. A process for drying temperature sensitive granular material, comprising the steps of:

a) placing a layer of the granular material in a substantially uniform high frequency electric field of a magnitude in the range of 10–30 kV/meter;

b) causing a substantially uniform dry gas flow to permeate through the material; and c) controlling the intensity of the electric field, the gas flow rate and the gas temperature to dry the material to a solvent level of less than one percent by weight in an energy efficient manner such that the material does not exceed a predetermined temperature, said temperature being substantially less than the boiling point of the solvent.

3. The process of claim 2, wherein the substantially uniform high frequency electric field is created between at least one energized electrode and at least one grounded electrode, the at least one energized electrode and the at least one grounded electrode being substantially parallel.

4. The process of claim 2, wherein the substantially uniform high frequency electric field is created at a frequency in the range of 10 MHz to 100 MHz.

5. The process of claim 2, wherein the frequency is selected from a group consisting of 13.6 MHz, 27.12 MHz and 40 MHz.

6. The process of claim 3, wherein at least one of the electrodes is perforated to permit gas to flow through the electrode and the substantially uniform dry gas flow is achieved by using at least one of the electrodes as a gas plenum.

7. The process of claim 2, wherein the velocity of gas flow through the product is in the range of 3–10 meters/minute.

8. The process of claim 2, further comprising sensing the temperature of the granular material and using the sensed temperature to control the electric field intensity.

9. The process of claim 8, further comprising a feedback controller to control the electric field intensity.

10. The process of claim 2, wherein placing step (a comprises conveying the granular material through the electric field in a first direction, the conveyor being comprised of a fabric substantially not susceptible to heating by the electric field, the fabric being perforated to facilitate the substantially uniform dry gas flow to permeate through the granular material.

11. The process of claim 10, wherein the conveyor is a continuous belt.

12. The process of claim 3, wherein the at least one energized electrode and the at least one grounded electrode are substantially planar.

13. The process of claim 3, wherein the at least one energized electrode comprises a first and a second energized electrode, and further wherein the region between the first electrode and the grounded electrode defines a first zone and the region between the second electrode and the grounded electrode defining a second zone.

14. The process of claim 13, wherein the control of the intensity of the electric field in the first and second zones is accomplished by positioning the first energized electrode at a first distance from the grounded electrode and positioning the second energized electrode at a second distance from the grounded electrode while applying a common voltage between the first energized electrode and the grounded electrode and between the second energized electrode and the grounded electrode.

15. The process of claim 13, the control of the intensity of the electric field in the first zone being accomplished by applying a first voltage between the first energized electrode and the grounded electrode and the control of the intensity of the electric field in the second zone being accomplished by applying a second voltage between the second energized electrode and the grounded electrode.

16. The process of claim 15, further comprising sensing a first temperature of the granular material in the first zone and sensing a second temperature of the granular material in a second zone and using the first and second sensed temperatures to respectively control the electric field intensity in the first and second zones.

17. An apparatus for drying temperature sensitive granular material, comprising:

a) means for creating a substantially uniform high frequency electric field of a magnitude in the range of 10–30 kV/meter;

b) means for placing a layer of the granular material in the substantially uniform high frequency electric field;

c) gas supply, collection and drying means for causing a substantially uniform dry gas flow to permeate through the material; and d) means for controlling the intensity of the electric field, the gas flow rate and the gas temperature to dry the material to a solvent level of less than one percent by weight in an energy efficient manner, such that the material does not exceed a predetermined temperature, said temperature being substantially less than the boiling point of the solvent.

18. The apparatus of claim 17, wherein the placing a layer of the granular material in the substantially uniform high frequency electric field comprises a conveyor, the conveyor being comprised of a fabric substantially not susceptible to heating by the electric field, the fabric being perforated to facilitate the substantially uniform dry gas flow to permeate through the granular material.

19. The apparatus of claim 18, wherein the conveyor is a continuous belt.

20. The apparatus of claim 17, further including temperature sensing means for sensing the temperature of the layer of granular material, wherein the temperature sensing means comprises at least one temperature probe and a temperature measurement module, said module creating an electrical signal representative of the temperature of the granular material.

21. The apparatus of claim 20, further comprising feedback controller means for using the sensed temperature of the granular material to control the electric field intensity.

22. The apparatus of claim 17, wherein the means for creating a substantially uniform high frequency electric field comprises at least one energized electrode and the at least one grounded electrode, the at least one energized electrode and the at least one grounded electrode being substantially parallel.

23. The apparatus of claim 22, wherein at least one of the electrodes is perforated to permit gas to flow through the electrode and the substantially uniform dry gas flow is achieved by using at least one of the electrodes as a gas plenum.

24. The apparatus of claim 22, wherein the at least one energized electrode and the at least one grounded electrode are substantially planar.

25. The apparatus of claim 22, wherein the at least one energized electrode comprises at least a first and a second energized electrode, and the grounded electrode is a common grounded electrode, the region between the first electrode and the grounded electrode defining a first zone and the region between the second electrode and the grounded electrode defining a second zone.

26. The apparatus of claim 25, further comprising voltage control means for applying a first voltage between the first energized electrode and the grounded electrode and for applying a second voltage between the second energized electrode and the grounded electrode to control the intensity of the electric field in the first and second zones.

27. The apparatus of claim 25, further comprising first temperature sensing means for sensing a first temperature of the granular material in the first zone and second temperature sensing means for sensing a second temperature of the granular material in a second zone, and feedback controller means for using the first and second sensed temperatures to control the electric field intensity in the first and second zones.

* * * * *